United States Patent [19]

LaPierre

[11] 4,054,240

[45] Oct. 18, 1977

[54] CARTON WITH INTEGRAL POURING SPOUT

[75] Inventor: James F. LaPierre, Franklin, Ohio

[73] Assignee: Interstate Folding Box Company, Middletown, Ohio

[21] Appl. No.: 729,184

[22] Filed: Oct. 4, 1976

[51] Int. Cl.[2] ..... B65D 5/74

[52] U.S. Cl. ..... 229/17 R; 222/528

[58] Field of Search ..... 229/7, 17; 222/528

[56] References Cited

U.S. PATENT DOCUMENTS

| | | | |
|---|---|---|---|
| 2,760,708 | 8/1956 | Phillips | 229/17 R |
| 3,096,011 | 7/1963 | Davis | 229/17 R |
| 3,178,090 | 4/1965 | Connell | 222/528 X |
| 3,184,137 | 5/1965 | Mohler | 222/528 X |
| 3,344,972 | 10/1967 | Robinson et al. | 229/17 R |
| 3,438,555 | 4/1969 | LaPierre | 222/528 |
| 3,989,171 | 11/1976 | Arneson | 229/7 R X |

*Primary Examiner*—Davis T. Moorhead

*Attorney, Agent, or Firm*—Melville, Strasser, Foster & Hoffman

[57] ABSTRACT

A paperboard carton having a large capacity pouring spout formed in a relatively narrow end wall, the pouring spout being fabricated as the carton is tubed into knocked-down flat-folded condition, the carton having an opposing pair of side walls and an opposing pair of relatively narrow end walls, with a glue flap hingedly connected to the side edge of one of the side walls, the glue flap being juxtaposed and adhesively secured to the inner surface of the adjacent end wall to form a tubular carton body; an outwardly displaceable pouring spout tab is formed in the end wall to which the glue flap is juxtaposed, the pouring spout tab being of generally rectangular configuration and having one of its side edges lying along the line of articulation between the end wall and the other of the side walls, the underlying glue flap being enlarged to extend across the full width of the end wall in the area of the pouring spout tab, the enlarged portion of the glue flap having an extension hingedly connected to its outermost side edge which is juxtaposed to the innersurface of the other of the carton side walls; a pouring spout being formed in the enlarged portion of the glue flap and its extension, the pouring spout having a generally rectangular center member secured to the inner surface of the pouring spout tab in the end wall, and a pair of wing members hingedly connected to the opposite sides of the center member, one of the wings being struck from the enlarged portion of the glue flap on one side of the center member, and the other wing being struck from the extension which lies along the inner surface of the other side wall, the outward displacement of the pouring spout tab causing the spout members to be displaced outwardly with the wings bearing against the opposite sides of the opening defined by the displaced pouring spout tab, the wings providing full depth side walls for the spout.

6 Claims, 6 Drawing Figures

CARTON WITH INTEGRAL POURING SPOUT

BACKGROUND OF THE INVENTION

The present invention relates to paperboard cartons, and more particularly to a carton having an integral pouring spout through which the contents of the carton may be dispensed.

Numerours types of pouring spout structures have hitherto been proposed for dispensing the contents of paperboard cartons. Many of the known constructions are unsatisfactory in that the spouts are not symmetrical and hence do not effectively dispense the contents. Others are difficult to open and close and often require a sharp instrument to initially displace the spout from the carton wall in which it is formed. Many are of complicated configuration and are difficult to fabricate, requiring special folding and gluing techniques and special equipment, all of which adds to the cost of the carton. Since it is desirable to minimize the amount of paperboard required to form the pouring spout, a particular problem has existed where the pouring spout is formed in a relatively narrow end wall - the end walls being the usual place in which pouring spouts are formed. Unless substantial additional quantities of box board are utilized, together with intricate folding and gluing of the parts, there is insufficient paperboard available to form a symmetrical spout having a relatively large pouring capacity, and particularly a spout which has full depth side walls. Usually there is insufficient board available to provide full depth side walls, with the result that the contents of the carton will readily spill over the narrow and often unsymmetrical side walls which are provided.

A number of the foregoing difficulties were overcome in U.S. Pat. No. 3,438,555 issued to the present inventor. In accordance with this patent, an integral pouring spout was formed from wall portions of the carton structure, the glue flap of the carton being extended in the area of the pouring spout to provide an inner wall panel having an inwardly displaceable flap which, when displaced, defined a V-shaped dispensing opening, the overlying body wall panel having a V-shaped spout part juxtaposed to the displaceable flap, with a second spout part hingedly connected to one side edge of the first spout part, the two spout forming parts being foldable relative to each other to define a spout, with the second spout part slidably engaging a side edge of the dispensing opening. While maintaining the quantity of additional paperboard required to form the pouring spout, as well as providing a symmetrical spout structure, the construction nonetheless requires a number of manipulative steps on the part of the user, inclusive of the displacement and folding of the spout forming parts relative to each other and the insertion of one of the parts into the opening defined by the initial inward displacement of the triangular flap part in the inner member. In addition, the size of the dispensing opening is limited by is triangular configuration which limits the dispensing capacity of the spout.

The present invention is an improvement on the construction taught in the aforesaid patent wherein, with but a very small additional amount of paperboard, a large capacity symmetrical pouring spout having a generally rectangular dispensing opening is provided, the spout additionally having full depth side walls which permit the contents to be dispensed at maximum capacity without spilling over the sides of the spout.

SUMMARY OF THE INVENTION

In accordance with the invention, a one-piece tubular carton is provided which is basically of conventional construction except for the enlargement of its glue flap to span the full width of the end wall to which it is secured in the area of the pouring spout, the enlarged area of the glue flap having a flap extension hingedly connected to its outermost side edge adapted to lie along the marginal side edge of the adjacent carton side wall.

The pouring spout is formed in the enlarged portion of the glue flap and its flap extension, the pouring spout having a generally rectangular center member and a pair of wing members hingedly connected to its opposite sides which form full depth side walls for the spout, the center member and one of the wing members being struck from the enlarged portion of the glue flap, with the remaining wing member struck from the flap extension. A pouring spout tab, also of generally rectangular configuration, is formed in the end wall overlying the glue flap, the pouring spout tab being aligned with the center member of the spout and adhesively secured thereto, the outward displacement of the pouring spout tab serving to define a dispensing opening in the carton end wall, the outward displacement of the tab carrying with it the underlying pouring spout the wings of which engage the opposite sides of the dispensing opening, the wings being configured to provide abutments which establish the fully opened position of the spout.

The spout structure is opened simply by displacing the pouring spout tab in the carton end wall outwardly, a recess being provided at the upper edge of the tab to facilitate its outward displacement, whereupon the side wall forming wings of the spout automatically assume their erected position. The spout may be readily reclosed simply by pushing inwardly on the tab. If desired, the carton may be provided with an overlap, in which event the only additional operation which need be performed by the user is the puncturing of the overwrap in the area of the pouring spout tab. The construction of the carton including the spout forming parts, is such that it can be fabricated using standard carton folding and gluing equipment, the spout structure being fully assembled as an incident of the tubing of the carton blanks.

DESCRIPTION OF THE PREFERRED EMBODIMENTS

Figure 1:
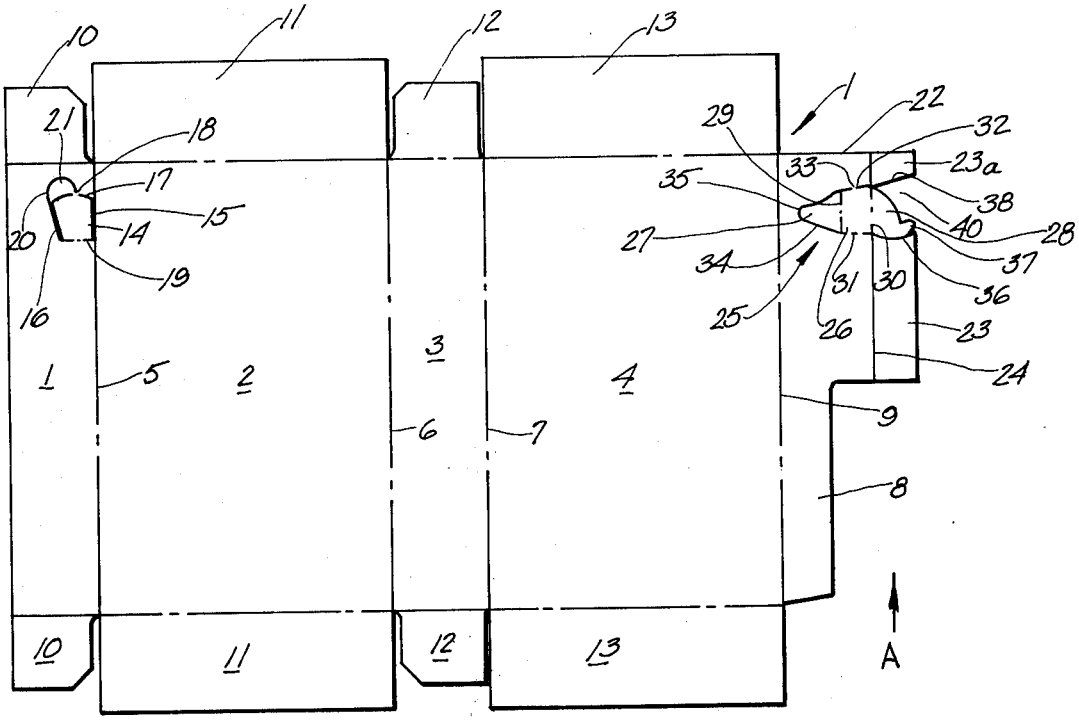
FIG. 1 is a plan view of a carton blank incorporating a pouring spout in accordance with the present invention.

Referring first to FIG. 1 which illustrates the carton blank for forming a pouring spout carton in accordance with the invention, the carton blank, indicated generally at 1, will be formed from paperboard or box board of any desired caliper, although it may be noted at the outset that the construction lends itself to heavier weight boards, such as Kraft boards, which provide heavy duty cartons, the cartons often being overwrapped with a proofing wrapper, such as foil, which is suitably printed to provide the desired package dress. A representative use of such cartons is the packaging of dishwasher detergent, the cartons being relatively narrow and of a size which may be conveniently handled and easily stored in the kitchen.

The blank 1 is cut and stored to define enclosing body walls 1, 2, 3 and 4 hingedly connected together along the lines of articulation 5, 6 and 7, respectively, the body walls 2 and 4 defining the opposite sides of the carton and the body walls 1 and 3 defining its relatively narrow end walls. A glue flap 8 is hingedly connected to the opposite side of body wall 4 along line of articulation 9. In the embodiment illustrated, sets of end closure flaps 10, 11, 12 and 13 are hingedly connected to the opposite ends of the respective body walls, the flaps illustrated comprising conventional seal end closure flaps. The specific nature of the closure flaps does not constitute a limitation on the invention, and any desired sets of end closure flaps may be employed.

In accordance with the invention, a generally rectangular pouring spout tab 14 is formed in body wall 1 adjacent its upper edge, the opposite sides of the tab being defined by the lines of cut 15 and 16, with its uppermost side edge defined by the line of cut 17 which may have a slight interruption or "nick", indicated at 18, to hold the tab in place until it is displaced outwardly, the "nick" breaking away when the tab is displaced, the tab pivoting outwardly along the line of articulation 19 which defines the lowermost edge of the tab. A semi-circular line of cut 20 extends upwardly from the line of cut 17, the paperboard lying within the confines of the semi-circular line of cut 20 being removed to provide a recess defining opening 21 which enables the user to engage the uppermost edge of the tab 14.

At the opposite side of the blank, the glue flap 8 is provided with an enlarged area 22 having a width equal to the width of body wall 1, the enlarged area having a flap extension 23 hingedly connected to its outermost side edge along the line of articulation 24.

A pouring spout, indicated generally at 25, is formed in part in the enlarged area 22 of the glue flap and in part in its flap extension 23. The pouring spout comprises a center part 26 and a pair of side forming wing parts 27 and 28 hingedly connected to the opposite sides of the center part along lines of articulation 29 and 30, respectively, the latter line of articulation lying along the line of articulation 24 so that wing part 28 lies within the confines of flap extension 23 whereas center part 26 and the remaining wing part 27 lie within the confines of the enlarged area 22 of the glue flap. The bottom edge of the center part 26 is defined by a line of articulation 31, whereas the upper edge of the center part is defined by a line of cut 32 of which, as in the case of pouring spout tab 14, may be provided with one or more interruptions or "nicks", such as the interruption 33, acting to maintain the parts of the spout in place until they are displaced. Wing part 27 is defined by a line of cut 34 which is contoured to define an abutment 35. The wing part 28 is defined by a line of cut 36 which is also contoured to define an abutment 37 at the outermost side edge of flap extension 23, which also has a line of cut 38 defining a stop tab **23*a* at the uppermost end of the flap extension, the area of the flap extension lying between the lines of cut 36 and 38 defining a scrap area 40** which is removed from the blank.

Figure 2:
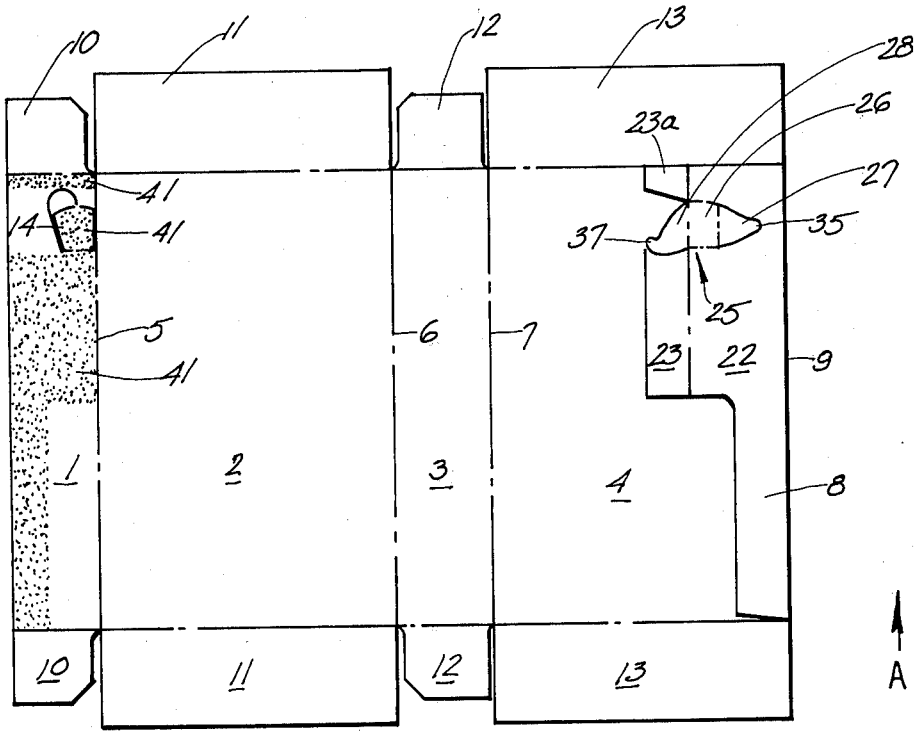
FIG. 2 is a plan view similar to FIG. 1 illustrating the initial steps in the fabrication of the carton blank into knocked-down tubular form.

The blank just described may be readily fabricated into a knocked-down carton structure using conventional straight-line folding and gluing equipment, the blank being advanced in a path of travel indicated by the Arrow A, whereupon glue applying means will be positioned to contact and apply areas of adhesive, indicated at 41 in FIG. 2, to the upper (inner) surface of narrow body wall 1. At the opposite side of the blank, the glue flap 8 will be infolded along line of articulation 9, thereby juxtaposing the glue flap, together with its enlarged portion 22 and flap extension 23, on underlying body wall 4, the parts thereby assuming the condition illustrated in FIG. 2. Thereafter the body wall panel 2 is infolded along line of articulation 6, thereby bringing the parts to the condition illustrated in FIG. 3, in which narrow body wall 1 overlies glue flap 8 and its enlarged area 22. Body wall 1 will thus be adhered to glue flap 8 and its enlarged area 22, although as will be evident from the location of the adhesive areas 41, the pouring spout 25 will be free from attachment to the overlying end wall except for center part 26 which is adhesively secured to pouring spout tab 14 which is positioned to overlie and contact the center part 26 of the pouring spout. The blank thus assumes the flat-folded tubed condition illustrated in FIG. 3; and as will be evident, the enlarged area 22 of the glue flap underlies body wall 1, whereas the flap extension 23 underlies adjoining side wall 2.

Figure 3:
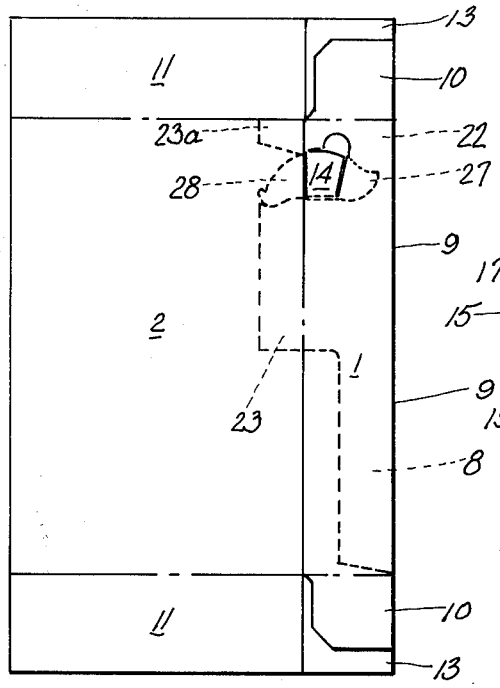
FIG. 3 is a plan view of the folded and tubed blank.
Figure 4:
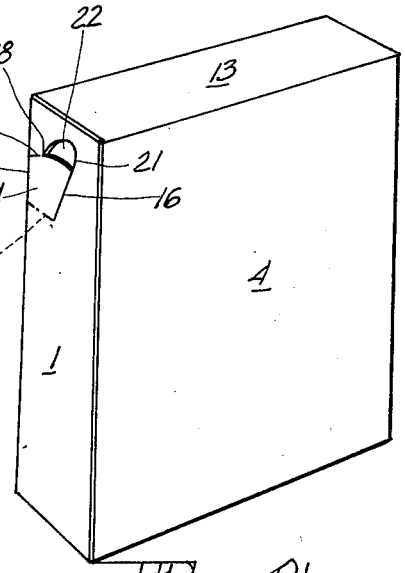
FIG. 4 is a perspective view illustrating the carton in fully erected condition with the pouring spout closed.

The carton blanks may be shipped to the packager in the knocked-down condition illustrated in FIG. 3, and it will be understood that in the hands of the packager the tubular bodies will be erected or "squared-up", whereupon one of the end closures will be closed and sealed, followed by the introduction of the contents into the carton from its open end, whereupon the remaining end closure flaps will be closed and sealed, thereby bringing the carton to the condition illustrated in FIG. 4.

Figure 5:
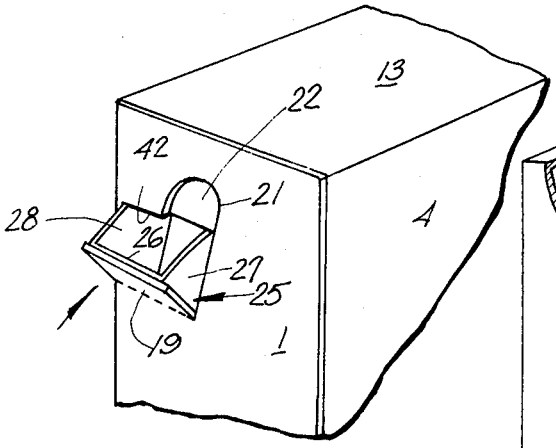
FIG. 5 is a fragmentary perspective view similar to FIG. 4 illustrating the carton with its spout in the fully opened position.
Figure 6:
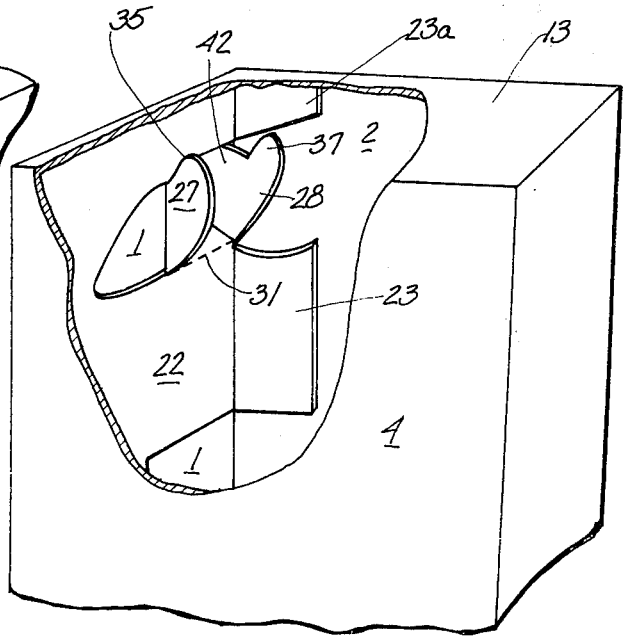
FIG. 6 is a fragmentary perspective view with parts broken away illustrating the manner in which the side forming wings of the spout engage the inner surfaces of the carton when the spout is opened.

When it is desired to dispense the contents, the user has only to engage the upper edge of pouring spout tab 14 in the area of recess 22, either with a fingernail or a sharp object, and displace the tab 14 outwardly, such displacement serving to break the tab free in the area of the interruption 18, the tab thus pivoting outwardly along its bottom edge defined by line of articulation 19. Outward displacement of tab 14 also causes outward displacement of the underlying pouring spout, the center part of which is adhesively secured to the inner surface of tab 14, the displacing movement also causing the rupture of the interruptions 33 which hold the center part of the pouring spout in place. The spout is thus extended to the open position illustrated in FIG. 5, the displaced tab 14 defining a generally rectangular dispensing opening 42. As will be evident from FIG. 5, the wing parts 27 and 28 form full depth side walls for the pouring spout, and hence provide maximum dispensing capacity. When the pouring spout is opened, the wing part 27, which initially lies in the plane of the enlarged area 22 of the glue flap, will be deflected by the adjoining side edge of the dispensing opening 42, and the wing part 28, which lies along the inner surface of side wall 2, is already folded at right angles to the center part 26 and hence simply moves outwardly, guided by the adjoining side edge of the dispensing opening. As will be evident from FIG. 6, the abutments 35 and 37 establish the fully opened position of the spout, the abutment 35 on wing part 27 engaging the inner surface of enlarged area 22 immediately above dispensing opening 42. Since wing part 28 lies in the plane of flap extension 23, its abutment 37 is configured to contact the undersurface of tab 23*a*, at the upper end of flap extension 23, and the configuration of the abutment 37 is such that it will contact extension tab 23*a* as tab 35 contacts enlarged area 22.

As should now be evident, the instant invention provides a symmetrical pouring spout having a relatively large capacity, yet the spout is formed in a relatively narrow end wall utilizing only slightly more board than is required to form a conventional tubular carton. In the hands of the user, the spout is extremely easy to open, requiring only a single pulling movement; similarly it may be closed by a simple pushing movement.

Modifications may be made in the invention without departing from its spirit and purpose. Various modifications have already been set forth and others will undoubtedly occur to the worker in the art upon reading this specification. Accordingly, it is not intended that the invention be limited other than in the manner set forth in the claims which follow.

The embodiments of the invention in which an exclusive property or privilege is claimed are defined as follows:

1. In a one-piece paperboard carton having a first end wall, a first side wall, a second end wall, and a second side wall in side-by-side articulation in the order named, and a glue flap hingedly connected to the remaining side edge of said second side wall, said glue flap being secured to the inner surface of said first end wall to form a tubular carton body, a generally rectangular pouring spout tab formed in said first body wall adjacent the upper end thereof, said tab being hingedly connected to said first end wall along its bottom edge and having one of its side edges lying along the line of articulation between said first end wall and said first side wall, said glue flap having an enlarged portion extending the full width of said first end wall in the area underlying said pouring spout tab, a flap extension hingedly connected to the outer side edge of the enlarged portion of said glue flap, said flap extension lying along the inner surface of said first side wall, a pouring spout formed in part in the enlarged portion of said glue flap and in part in said flap extension, said pouring spout having a generally rectangular center part underlying and secured to said pouring spout tab, a first wing part hingedly connected to one side edge of said center part, said first wing part being formed in the enlarged portion of said glue flap, and a second wing part hingedly connected to the opposite side edge of said center part, said second wing part being formed in said flap extension, said first extension being substantially no greater in width than the width of said second wing part.

2. The carton structure claimed in claim 1 including a recess defining opening in said first end wall extending upwardly from the upper edge of said pouring spout tab, whereby a portion at least of the upper edge of said tab is exposed so that it may be readily engaged for opening movement.

3. The carton structured claimed in claim 2 including abutment means on said wing parts engageable with inner surfaces of the carton body when the pouring spout is displaced outwardly, said abutments establishing the fully opened position of the pouring spout.

4. The carton structure claimed in claim 1 wherein said pouring spout tab, when displaced outwardly, defines a generally rectangular dispensing opening in said first end wall, and wherein the wing parts of said pouring spout are dimensioned to completely close the opposite sides of said dispensing opening, thereby providing full depth side walls for said pouring spout.

5. The carton structure claimed in claim 1 wherein the top and opposite side edges of said pouring spout tab are defined by lines of cut, and wherein at least one of said lines of cut is interrupted so as to releasably maintain the pouring spout tab in the plane of said first end wall.

6. The carton structure claimed in claim 5 wherein the upper edge of the central part of said pouring spout is defined by a line of cut, and wherein said line of cut is interrupted so as to releasably maintain the central portion of the pouring spout in the plane of the flap in which it is formed.

* * * * *